US007284828B2

(12) United States Patent
Briggs

(10) Patent No.: US 7,284,828 B2
(45) Date of Patent: Oct. 23, 2007

(54) METHOD AND APPARATUS FOR COLOR FORMATTING IN A COLOR PRINTER

(75) Inventor: Randall Don Briggs, Boise, ID (US)

(73) Assignee: Marvell International Technology Ltd. (BM)

( * ) Notice: Subject to any disclaimer, the term of this patent is extended or adjusted under 35 U.S.C. 154(b) by 0 days.

(21) Appl. No.: 11/401,525

(22) Filed: Apr. 10, 2006

(65) Prior Publication Data

US 2006/0181572 A1 Aug. 17, 2006

Related U.S. Application Data

(63) Continuation of application No. 10/714,051, filed on Nov. 14, 2003, now Pat. No. 7,036,908.

(51) Int. Cl.
*B41J 2/21* (2006.01)

(52) U.S. Cl. ..... 347/43

(58) Field of Classification Search ..... 347/43, 347/49

See application file for complete search history.

(56) References Cited

U.S. PATENT DOCUMENTS 6,005,592 A * 12/1999 Koizumi et al. ..... 345/571
6,049,394 A * 4/2000 Fukushima ..... 358/1.9
6,178,475 B1 * 1/2001 O'Brien ..... 710/116
6,206,504 B1 * 3/2001 Payne ..... 347/43

* cited by examiner

*Primary Examiner*—Thinh Nguyen

(57) ABSTRACT

A printer includes a print engine and a monochrome formatter connected to the print engine and being operatively connectable to a color chip. A monochrome print engine and a monochrome formatter provide a monochrome printer. A color print engine and a monochrome formatter operatively connected to a color chip provide a color printer.

36 Claims, 3 Drawing Sheets

METHOD AND APPARATUS FOR COLOR FORMATTING IN A COLOR PRINTER

This is a Continuation of copending application Ser. No. 10/714,051, filed on Nov. 14, 2003 now U.S. Pat. No. 7,036,908, the entire disclosure of which is incorporated herein by reference.

TECHNICAL FIELD

The present invention relates generally to laser printers, and more particularly to a method and apparatus for color formatting in a color printer.

BACKGROUND ART

Laser printers have become very popular in recent times due to their ability to print clear images. Generally, laser printers are available as monochrome only printers, such as printers that print only in black, or color printers that print in color as well as monochrome. These printers operate by converting an image on a client device such as a personal computer into data that is received by a formatter that stores the data in the printer. The formatter generates coded data representing the image, which is then transmitted by the formatter to a print engine that drives the mechanisms of the printer to convert the data back into an image that is printed on a print medium, such as paper.

Formatters utilize integrated circuits (chips) to perform the formatting function in a printer. A single chip solution for both monochrome and color formatting provides the functions for both monochrome formatting and color formatting in a single chip. The single chip then can be used in both color printers and monochrome printers.

The single chip solution has several drawbacks, however. The primary problem with the single chip solution is that, when used in a monochrome printer, the color formatting capability is wasted. The circuitry associated with performing the color formatting function consumes valuable chip area. Monochrome printers are cost sensitive, so including the color formatting circuitry in the single chip adds unacceptable cost to the monochrome printer.

Another solution that has been used to provide both color formatting and monochrome formatting capability is a two-chip solution. The two-chip solution attempts to optimize the monochrome formatter by placing all the functional blocks that are unique to the color formatter onto a separate chip, sometimes referred to as a color chip. The color chip is then attached to the monochrome chip using a high-speed expansion bus, such as a Peripheral Component Interconnect (PCI) bus.

The two-chip solution successfully simplifies the monochrome chip thereby reducing its cost by removing the color formatting specific functional blocks to the color chip, but much of this cost advantage is negated by the necessary addition of the high-speed expansion bus to both the monochrome chip and the color chip. Furthermore, the performance of both the monochrome chip and the color chip are affected adversely by data transfer time over the high-speed expansion bus.

An additional solution that has been attempted is an independent chip solution. The independent chip solution provides two separate and independent chips. One chip provides the monochrome formatter and is used only in monochrome printers. A second separate and independent chip provides the color formatter and is used only in color printers.

The independent chip solution also has disadvantages. Each chip is designed separately thereby increasing the cost of designing both chips. The color chip by necessity includes some of the common functionality the color chip has with the monochrome chip. Further, the economies of scale are not present; i.e., the manufacturing cost benefit of the relatively high production volumes of the monochrome chip is lost.

Solutions to these problems have been long sought but prior developments have not taught or suggested any solutions and, thus, solutions to these problems have long eluded those skilled in the art.

DISCLOSURE OF THE INVENTION

The present invention provides a printer including a print engine and a monochrome formatter connected to the print engine and being operatively connectable to a color chip. A monochrome print engine and a monochrome formatter provide a monochrome printer. A color print engine and a monochrome formatter operatively connected to a color chip provide a color printer.

The present invention provides a monochrome chip solution that is less complex and less expensive than the single-chip solution while providing a two-chip color solution that is less complex and less expensive than existing two-chip color solutions.

The modular architecture of the present invention provides a solution using smaller design teams than are used to design existing independent chip solutions.

The present invention provides the addition of color formatting capability to a monochrome formatting chip without the additional cost of providing a high-speed expansion bus.

Certain embodiments of the invention have other advantages in addition to or in place of those mentioned above. The advantages will become apparent to those skilled in the art from a reading of the following detailed description when taken with reference to the accompanying drawings.

BEST MODE FOR CARRYING OUT THE INVENTION

In the following description, numerous specific details are given to provide a thorough understanding of the invention. However, it will be apparent to one skilled in the art that the invention may be practiced without these specific details. In order to avoid obscuring the present invention, some well-known circuits, system configurations, and process steps are not disclosed in detail. Likewise, the drawings showing embodiments of the apparatus are diagrammatic and not to scale for clarity of presentation.

As used herein, the term "printer" will be understood to encompass all image printing devices that receiving a data stream representing an image and, from that data stream, print the represented image on a print medium, for example, a sheet of a paper. The term "print medium," as used herein, will be understood to encompass paper, paper-based products and sheets or planar sections of all other material on which an image may be printed. The term "print medium" will also be understood to encompass an intermediate transfer belt or similar device on which an image is built up before being transferred to another print medium.

Figure 1:
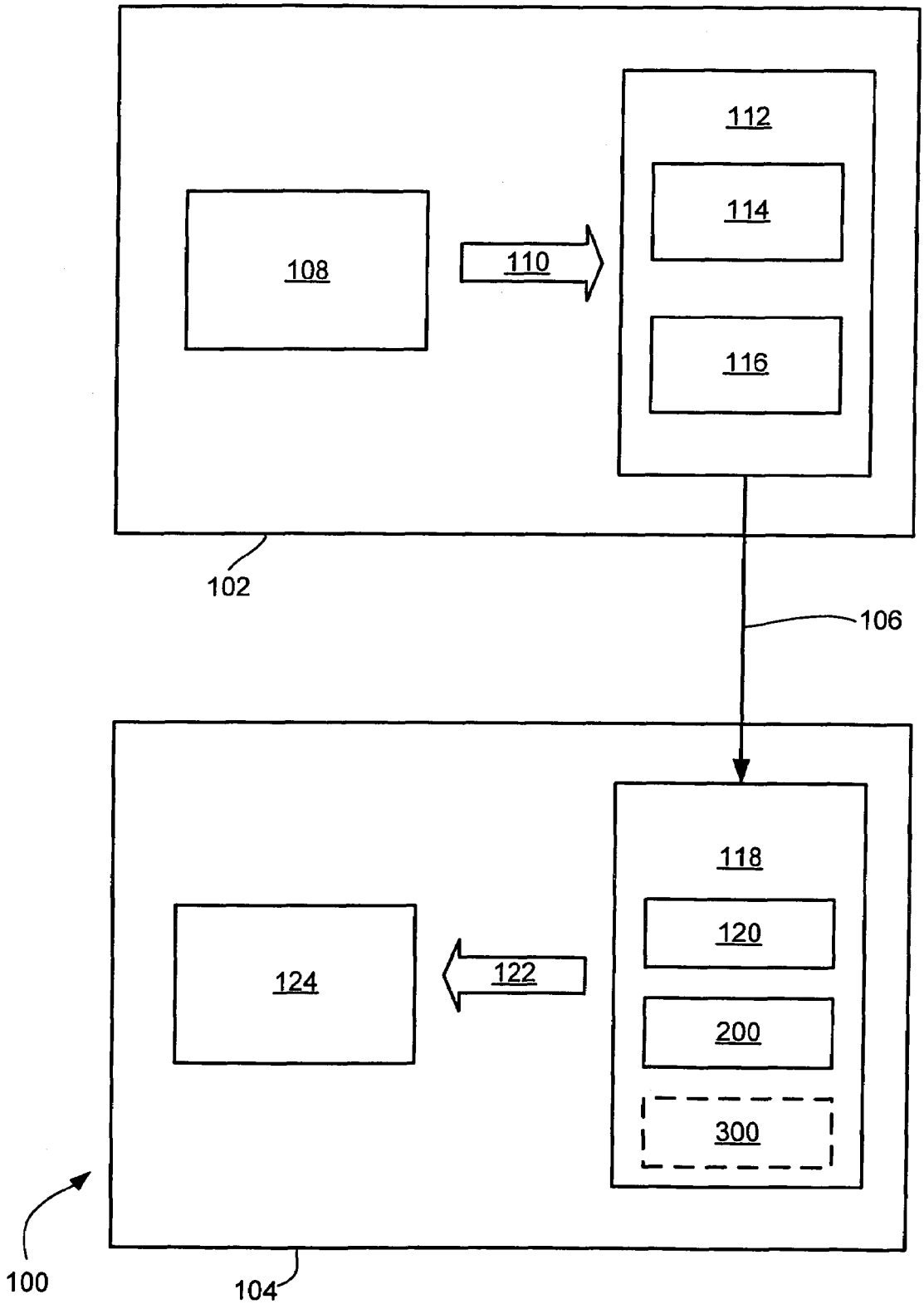
FIG. 1 is a block diagram of a system in accordance with the present invention.

Referring now to FIG. 1 therein is shown a block diagram of a printing system 100 manufactured in accordance with the present invention. The printing system 100 includes a printer client device 102, such as a personal computer, a mainframe computer, a server, a scanner, a modem, a fax machine, a video camera, a videocassette recorder, a digital videodisc, or laser disc player, personal digital assistant, wireless telephone or any other device capable of generating or transmitting image data for printing. The printing system 100 also includes a printer 104, which can be a monochrome or color printer.

A connection 106 is provided between the printer client device 102 and the printer 104 over which the printer client device 102 can transmit image data in the form of print jobs to the printer 104. The connection 106 may be a direct serial or parallel connection between the printer client device 102 and the printer 104. Alternatively, the connection 106 may be over a local area network (LAN) or a wide area network (WAN). The connection 106 may also be a wireless connection or any other connection over which data can be transferred from the printer client device 102 to the printer 104.

The printer client device 102 runs an application 108 that generates image data 110 representing an image, which is to be printed. The image data 110 is transmitted to a printer driver 112 that is also running on the printer client device 102. The printer driver 112 comprises three operations that are performed on the image data 110.

First, a rasterizer 114 rasterizes the image data 110 to prepare the image data 110 for the printer 104. Next, for a color printer, a color plane separator 116 separates the image data 110 into color planes matching the toner in the printer 104. There are typically four color planes: cyan (C), yellow (Y), magenta (M) and black (K). Finally, the image data is compressed for transfer over the connection 106.

In general, there are two types of color printers. A single-pass, or in-line, color printer prints all four of the color planes of the image data 110 (i.e., cyan (C), yellow (Y), magenta (M) and black (K) nearly simultaneously, i.e., in one-pass over the print medium. In contrast, a four-pass color printer makes four passes over the print medium, printing a separate color plane on each pass. The method and apparatus of the present invention can be used with either the single-pass or the four-pass color printer.

The printer driver 112 transmits the image data 110 corresponding to a single color plane over the connection 106 to the printer 104. The printer 104 will likely have a predetermined order in which the four color planes are to be printed. If so, the printer driver 112 will be programmed to transmit the image data 110 for the color planes in the sequence required by the printer 104. However, those skilled in the art will appreciate that the order in which the color planes are transmitted to the printer 104 is not critical to the invention and can be arranged to optimize the functioning of the printer 104 being used.

The image data 110 is received in the printer 104 by a formatter 118, which stores the image data 110, such as in a storage device 120. The formatter 118 for a monochrome printer has a monochrome chip 200 shown in FIG. 2, and for a color printer a color chip 300 shown in FIG. 3 is added. Since the color chip 300 is optional, it is shown in dotted lines.

When all the image data 110 for a particular color plane is received and buffered, the formatter 118 passes the image data 110 to a print engine 124, which drives the mechanisms of the printer 104 to print image data 122 on a print medium (not shown), such as paper.

Figure 2:
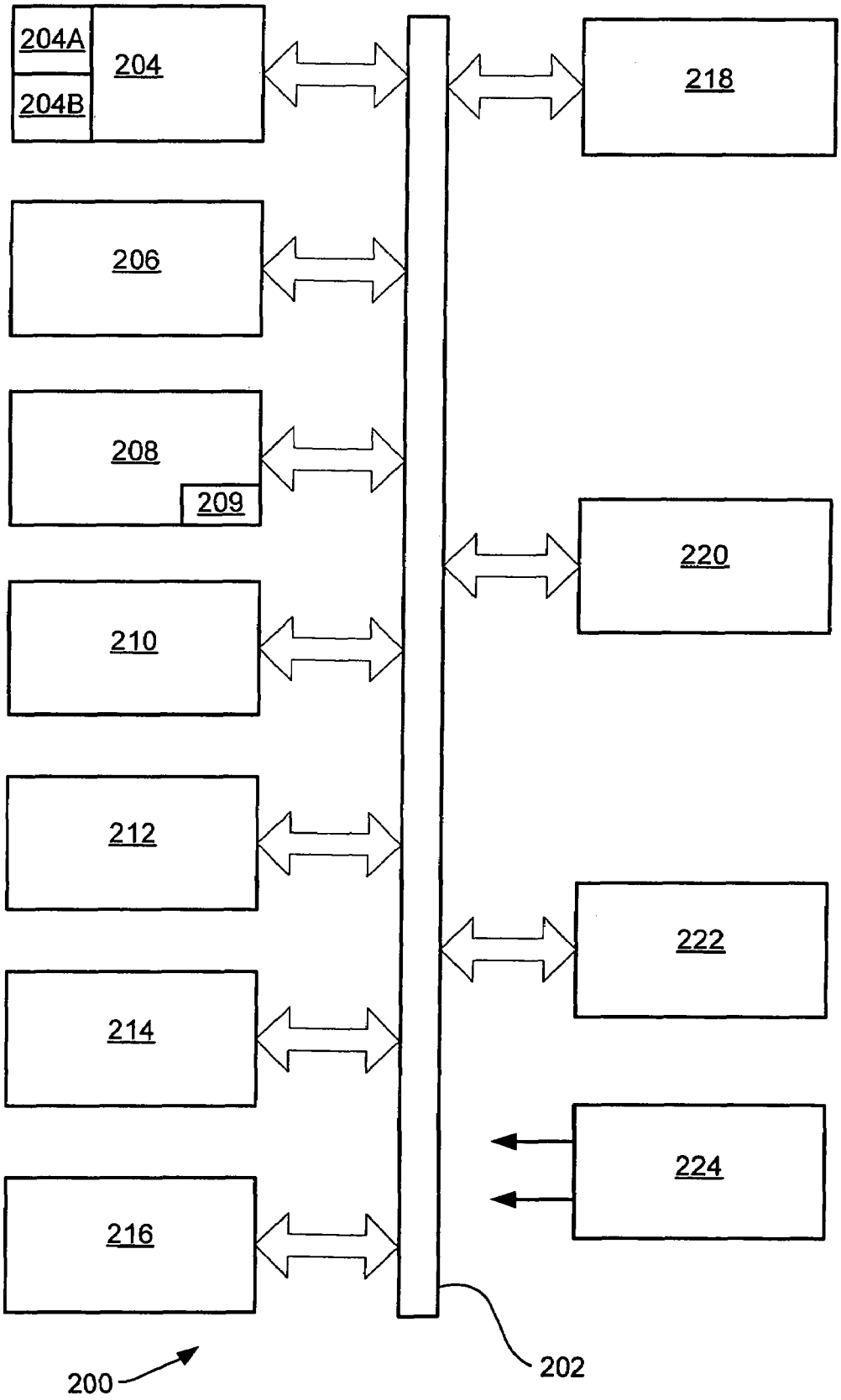
FIG. 2 is a block diagram of a monochrome chip in accordance with the present invention.
Figure 3:
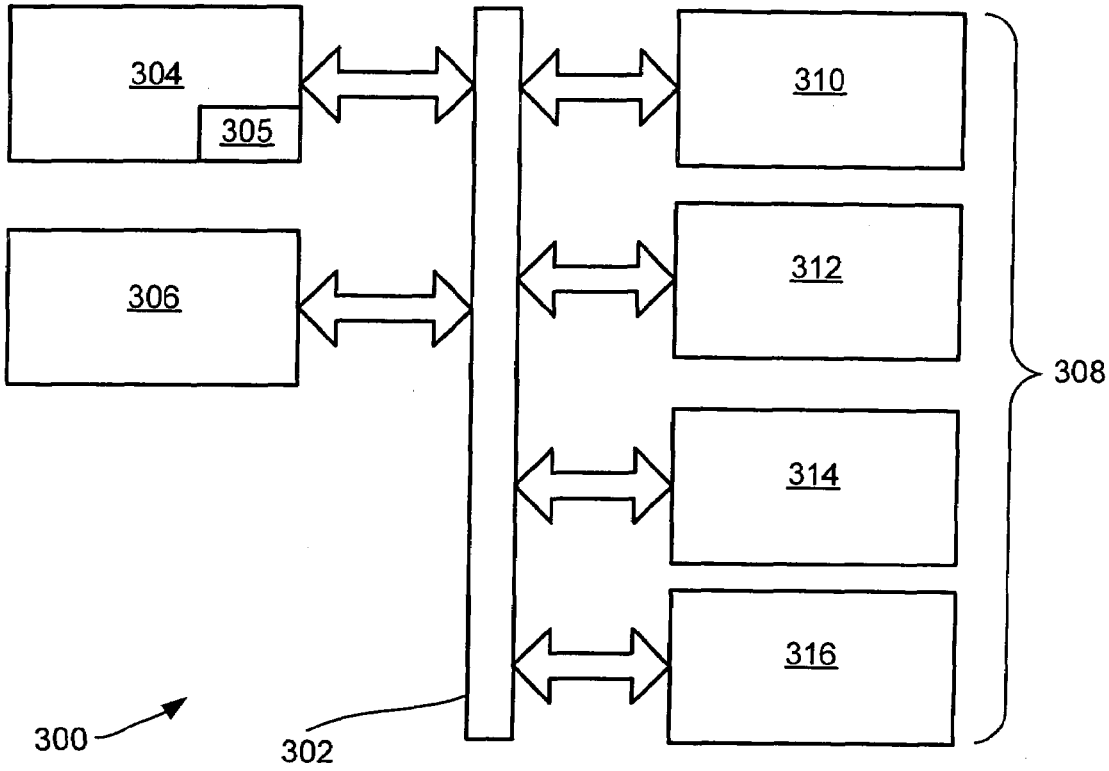
FIG. 3 is a block diagram of a color chip in accordance with the present invention.

Referring now to FIG. 2, therein is shown a block diagram of the monochrome chip 200 of the formatter 118 shown in FIG. 1 manufactured in accordance with the present invention. The monochrome chip 200 has a first internal communication bus 202 to which are connected the various function blocks of the monochrome chip 200.

A processor 204 is connected to the first internal communication bus 202. The processor 204 includes an instruction cache 204A and a data cache 204B.

A storage device 206, such as a 32 Kbytes read only memory (ROM), is used to store program instructions. The storage device 206 also is connected to the first internal communication bus 202.

A first memory controller 208 is connected to the first internal communication bus 202 for controlling access to the storage device 120 on the formatter 118. The first memory controller has an arbiter 209 for determining which chip receives access to the storage device 120.

A first decompressor 210, such as a JBIG (Joint Bi-level Industry Group) compliant decompressor, is connected to the first internal communication bus 202 for decompressing data received in a compressed form from the printer client device 102 shown in FIG. 1.

A first interface port 212, such as a Universal Serial Communication bus (USB) port, is connected to the first internal communication bus 202 for input/output (I/O) interface with the printer 104 shown in FIG. 1.

A second interface port 214, such as a media access controller (MAC), for example a 10/100 MAC, is connected to the first internal communication bus 202 for controlling additional I/O to a media independent interface (MII) to a local area network (LAN) if the printer 104 shown in FIG. 1 is part of the LAN.

A third interface port 216, such as a parallel printer port, is connected to the first internal communication bus 202 for an alternative I/O to the printer 104 shown in FIG. 1.

A first monochrome video channel 218 is connected to the first internal communication bus 202 for transmitting data to the printer 104

A printer engine interface 220 is connected to the first internal communication bus 202 for driving conventional printer mechanisms of the printer 104 when called for by the printing system 100.

A processor support block 222 is connected to the first internal communication bus 202 for providing various support functions for the processor 204, such as a General Purpose I/O interface (GPIO), timers, interrupts, and other functions in support of the processor 204.

A clocking block 224, such as a phased lock loop (PLL), also is included in the monochrome chip 200 for providing clock signals to the various components of the formatter 118.

The monochrome chip 200 can be used as the formatter in a monochrome printer, or, as described below, combined with the color chip 300 (shown in FIG. 3) to form a color formatter for use in printer 104 as a color printer.

Referring now to FIG. 3, therein is shown a block diagram of the color chip 300 manufactured in accordance with the present invention. The color chip 300 comprises those functions that are specific to a color formatter. The color chip 300 has a second internal communication bus 302 to which are connected the various function blocks of the color chip 300.

A second memory controller 304 is connected to the second internal communication bus 302 for controlling the access to the storage device 120 for the printer. The second memory controller 304 has a requestor 305 for requesting access to the storage device 120 from the arbiter 209 in the monochrome chip 200 shown in FIG. 2.

A second decompressor 306, such as a JBIG (Joint Bi-level Industry Group) compliant decompressor, is connected to the second internal communication bus 302 for decompressing data. The second decompressor 306 in the color chip 300 is needed since more data is sent from the printer client device 102 shown in FIG. 1 for color images than for monochrome images. The second decompressor 306 and the first decompressor 210 shown in FIG. 2 are used together to meet the decompression throughput necessary to provide data to the printer 104 at a rate that is fast enough to keep pace with the print engine 124 shown in FIG. 1.

A number of color channels 308 are connected to the second internal communication bus 302 for transmitting color data to the printer 104 shown in FIG. 1. The number of color channels 308 includes a cyan color channel 310, a yellow color channel 312, a magenta color channel 314, and a black color channel 316 for transmitting CYMK color data.

Figure 4:
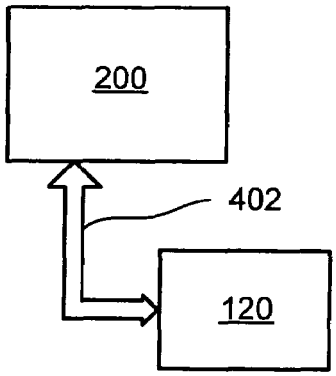
FIG. 4 is a block diagram of a monochrome formatter in accordance with the present invention.

Referring now to FIG. 4, therein is shown a block diagram of a monochrome formatter 400 comprising the monochrome chip 200 shown in FIG. 2 connected to the storage device 120 by an interconnection bus 402.

Figure 5:
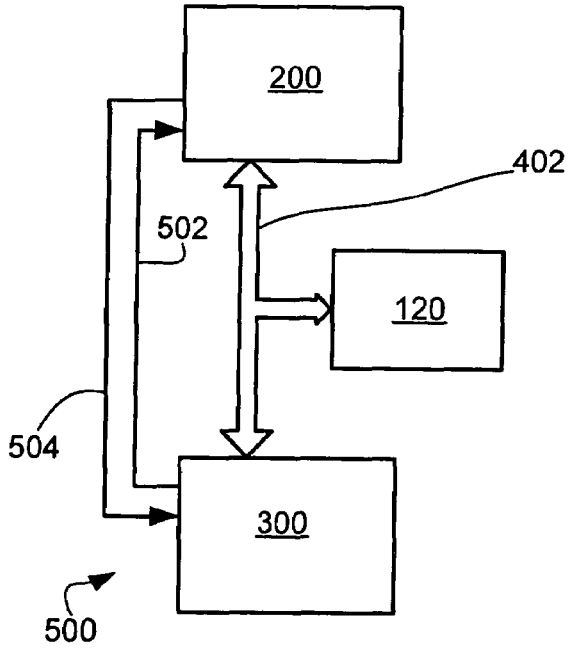
FIG. 5 is a block diagram of a color formatter in accordance with the present invention.

Referring now to FIG. 5, therein is shown a block diagram of a color formatter 500 comprising the monochrome chip 200 shown in FIG. 2 and the color chip 300 shown in FIG. 3. The color chip 300 is connected to the interconnection bus 402 along with the monochrome chip 200 and the storage device 120.

Alternatively, the storage device 120 can communicate with either the monochrome chip 200 or the color chip 300. The storage device 120 assists in the communication of data between the monochrome chip 200 and the color chip 300.

The first internal communication bus 202, the interconnection bus 402, and the second internal communication bus 302 operate together to provide access to storage device 120 as if internal communication bus 202 and internal communication bus 302 were a single bus on one chip. In the printer 104, the second internal communication bus 302 is "operatively connected" to the first internal communication bus 202 of the monochrome chip 200 of FIG. 2. For purposes of the present invention, "operatively connected" is defined to mean that the first and second internal communicated buses 202 and 302 are connected to act as a single internal communication bus without the use of a high-speed expansion bus. Similarly, the expression "being operatively connectable" is defined to mean that the monochrome chip 200 is designed to be operatively connected to the color chip 300.

It has been discovered that the defined operative connection provides a monochrome chip solution that is less complex and less expensive than the single-chip solution while providing a two-chip color solution that is less complex and less expensive than existing two-chip color solutions.

For example, incoming compressed data from the connection 106 shown in FIG. 1 is received into the storage device 120. The first decompressor 210 shown in FIG. 2 and the second decompressor 306 shown in FIG. 3 each have equal and identical access to this compressed data to decompress the compressed data and write the resulting decompressed data back to the storage device 120. The color channels 310, 312, 314, and 316 are able to access the decompressed data from the storage device 120 and send the decompressed data to the print engine 124 shown in FIG. 1 in conjunction with the printer engine interface 220 shown in FIG. 2. The data flow from the functional blocks on the monochrome chip 200 and the color chip 300 is the same as if the functional blocks were all on a single chip. It has been discovered that no data transfer performance is lost due to the interconnection of the color chip 300 to the monochrome chip 200 using the present invention, except for a negligible amount of time for handling the bus ownership exchange described below.

In the embodiment shown in FIG. 5, the interconnection bus 402 has two additional lines. A request (REQ) line 502 and a grant (GNT) line 504, although it will be apparent to those skilled in the art that other means of communicating bus access between the monochrome formatter and the color chip may be used. The REQ line 502 is used by the color chip 300 of FIG. 3 to send a signal to the monochrome chip 200 of FIG. 2 requesting access to the storage device 120. The GNT line 504 is used by the monochrome chip 200 to send a signal to the color chip 300 granting access to the storage device 120, whereupon the monochrome chip 200 will tri-state its control signals to the storage device 120, and the color chip 300 may begin driving them. There thus is provided a two-chip solution that does not require an additional high-speed bus to connect the monochrome chip 200 and the color chip 300, such as a PCI bus.

The color chip 300 does not need its own processor because it can use the processor 204 shown in FIG. 2 in the monochrome chip 200 to setup its registers, service its interrupts, and manage its color channels 308. The registers in the color chip 300 are memory mapped into the address space of the monochrome chip 200, such as by using a conventional SRAM interface model using a chip select, write strobe, read strobe, address signals, and data signals. When the color chip 300 does not currently have access to the storage device 120, the bus interface of the color chip 300 is set to receive these control signals to communicate register accesses.

In operation, when a user of the printing system 100 desires to print, for example by hitting the print key on the printer client device 102, such as a personal computer, the printer driver 112 in the printer client device 102 converts the image to be printed into the image data 110 as shown in FIG. 1. The image data 110 is sent to the formatter 118 in the printer 104.

The image data 110 shown in FIG. 1 is received through the first interface port 212 shown, the second interface port 214, or the third interface port 216 on the monochrome chip 200 as shown in FIG. 2 depending upon the particular I/O port to which the printer 104 shown in FIG. 1 is connected. The image data 110 is sent via the first internal communication bus 202 of FIG. 2 to the storage device 120. After the image data 110 is decompressed by the first decompressor 210 shown in FIG. 2 and/or the second decompressor 306 shown in FIG. 3, the decompressed data is written back to the storage device 120. The first memory controller 208 controls the flow of data for the first decompressor 210 into and out of the storage device 120. The second memory controller 304 controls the flow of data for the second decompressor 306 into and out of the storage device 120.

The processor 204, using a program stored in the storage device 120, manages and directs the data transfer.

If the image data 110 shown in FIG. 1 is indicative of a color image, the processor 204 writes a register in the color chip 300 of FIG. 3. The color chip 300 of FIG. 3 sends a signal over the REQ line 502 to the arbiter 209 in the first memory controller 208 on the monochrome chip 200 of FIG. 2 requesting access to the storage device 120. The arbiter 209 of FIG. 2 eventually sends a signal to the color chip 300 of FIG. 3 on the GNT line 504 granting the color chip 300 access to the storage device 120.

Once access to the storage device 120 is granted to the color chip 300, the color chip 300 reads the image data 110 using a number of color channels 308. The cyan color channel 310 fetches the cyan color data. The yellow color channel 312 fetches the yellow color data. The magenta color channel 314 fetches the magenta color data. The black color channel 316 fetches the black color data.

The processor 204 determines that it is time to print the image and sends a signal to the printer engine interface 220 in FIG. 2 to start the printer mechanisms. The color channels 308 receive signals from the print engine 124 indicating when the paper is in position to receive the data. When the signals are received, the color channels drive the image data 122 to the print engine 124, drawing the data out of the storage device 120, using a direct memory access (DMA) mechanism.

If the printer 104 is a single-pass color printer, all four of the color planes of the image data 110 (i.e., cyan (C), yellow (Y), magenta (M) and black (K) are sent nearly simultaneously, and printed in one-pass over the print medium. If the printer 104 is a four-pass color printer the color data is sent to the printer serially and the printer 104 makes four passes over the print medium, printing a separate color plane on each pass.

The present invention provides a monochrome formatting solution that is less expensive than the single-chip monochrome formatting solution that includes both monochrome and color formatting capabilities while providing a two-chip color formatting solution that is less expensive than existing two-chip color formatting solutions.

The modular architecture of the present invention provides a solution using smaller design teams than are used to design existing independent chip solutions.

The present invention provides the addition of color formatting capability to a monochrome formatting chip without the additional cost of providing a high-speed expansion bus.

Thus, it has been discovered that the color formatting method and apparatus of the present invention furnish important and heretofore unavailable solutions, capabilities, and functional advantages. The resulting process and configurations are straightforward, economical, uncomplicated, highly versatile, and effective, use conventional technologies, and are thus readily suited for manufacturing color printers and are fully compatible with conventional manufacturing processes and technologies.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the spirit and scope of the included claims. All matters hitherto-fore set forth herein or shown in the accompanying drawings are to be interpreted in an illustrative and non-limiting sense.

The invention claimed is:

1. A printer formatter comprising:

a formatter bus;

a storage connected to the formatter bus for storing image data; and a monochrome chip having a chip bus connectable to the formatter bus, and a bus arbiter capable of arbitrating access to image data in the storage over the formatter bus.

2. The printer formatter of claim 1, wherein the chip bus of the monochrome chip is adapted to directly connect to the formatter bus.

3. The printer formatter of claim 1, wherein the chip bus of the monochrome chip is directly coupled to a corresponding bus of a color chip that is connected to the formatter bus.

4. The printer formatter of claim 1, wherein the monochrome chip further comprises a processor disposed for connection with the chip bus.

5. The printer formatter of claim 4, wherein the processor is adapted to be shared with a color chip over the formatter bus.

6. The printer formatter of claim 1, wherein the monochrome chip further comprises a printer engine interface disposed for connection with the chip bus.

7. The printer formatter of claim 1, wherein the monochrome chip further comprises a monochrome video channel disposed for connection with the chip bus.

8. The printer formatter of claim 1, wherein the monochrome chip further comprises at least one printer interface circuit disposed for connecting printer data from a printer client device with the chip bus.

9. The printer formatter of claim 8, wherein the at least one printer interface circuit comprises an interface selected from an interface group consisting of a USB port, a parallel printer port, a serial printer port, and a network printer interface.

10. A printer formatter comprising:

formatter bus means for interconnecting one or more components of the printer formatter;

storage means for storing image data, the storage means being connected to the formatter bus means; and monochrome chip means for processing monochrome image data, where the monochrome chip means includes a chip bus connecting the monochrome chip means to the formatter bus means, and a bus arbiter adapted to arbitrate access to data in the storage means over the formatter bus means.

11. The printer formatter of claim 10, wherein the chip bus of the monochrome chip means is adapted to directly connect to the formatter bus means.

12. The printer formatter of claim 10, wherein the chip bus of the monochrome chip means is adapted to directly connect to a corresponding bus of a color chip means for processing color image data, where the color chip means is connected to the formatter bus means.

13. The printer formatter of claim 10, wherein the monochrome chip means further comprises a processor disposed for connection with the chip bus.

14. The printer formatter of claim 13, wherein the processor is adapted to be shared with a color chip means for processing color image data.

15. The printer formatter of claim 10, wherein the monochrome chip means further comprises a printer engine interface disposed for connection with the chip bus.

16. The printer formatter of claim 10, wherein the monochrome chip means further comprises a monochrome video channel disposed for connection with the chip bus.

17. The printer formatter of claim 10, wherein the monochrome chip means further comprises at least one printer interface circuit disposed for connecting printer data from a printer client device with the chip bus.

18. The printer formatter of claim 17, wherein the at least one printer interface circuit comprises an interface selected from an interface group consisting of a USB port, a parallel printer port, a serial printer port, and a network printer interface.

19. A process for operating a printer formatter comprising:

storing image data;

using a monochrome chip to arbitrate access to the stored image data; and executing printer operations using a processor of the monochrome chip.

20. The process for operating the printer formatter of claim 19, further comprising using a chip bus of the monochrome chip to directly access a corresponding bus of a color chip.

21. The process for operating the printer formatter of claim 19, further comprising using a chip bus of the monochrome chip to directly access the stored image data.

22. The process for operating the printer formatter of claim 19, further comprising sharing the processor of the monochrome chip with a color chip over a bus.

23. The process for operating the printer formatter of claim 19, further comprising providing communication between the monochrome chip and a printer engine.

24. The process for operating the printer formatter of claim 19, further comprising transmitting monochrome printer data to a printer.

25. The process for operating the printer formatter of claim 19, further comprising communicating printer data from a printer client device to the monochrome chip.

26. The process for operating the printer formatter of claim 25, wherein the printer data is communicated using an interface selected from an interface group consisting of a USB port, a parallel printer port, a serial printer port, and a network printer interface.

27. A printer formatter comprising:

a formatter bus;

a storage connected to the formatter bus for storing image data; and a color chip having a chip bus connectable to the formatter bus, and a bus requester capable of requesting access to the image data in the storage over the formatter bus.

28. The printer formatter of claim 27, further comprising a monochrome chip having a chip bus connectable to the formatter bus, and a bus arbiter responsive to the bus requester of the color chip to arbitrate access to image data in the storage over the formatter bus.

29. The printer formatter of claim 28, wherein the chip bus of the color chip is adapted to directly connect to the chip bus of the monochrome chip.

30. A printer formatter comprising:

formatter bus means for interconnecting one or more components of the printer formatter;

storage means for storing image data, where the storage means is coupled to the formatter bus means; and color chip means for processing color image data, the color chip means having a chip bus connecting the color chip means to the formatter bus means, and a bus requester adapted to request access to the image data in the storage means over the formatter bus means.

31. The printer formatter of claim 30, further comprising monochrome chip means for processing monochrome image data, the monochrome chip means having a chip bus connecting the monochrome chip means to the formatter bus means, the monochrome chip means further having a bus arbiter adapted to arbitrate access to image data in the storage means over the formatter bus means, where the bus arbiter is responsive to the bus requester of the color chip means to arbitrate access to the image data by the color chip means.

32. The printer formatter of claim 31, wherein the chip bus of the color chip means is adapted to directly connect to the chip bus of the monochrome chip means.

33. A process for operating a printer formatter comprising:

storing image data;

issuing a bus request from a color chip to access the stored image data;

receiving at the color chip bus access permission from a bus arbiter of a monochrome chip; and accessing the stored image data over a chip bus of the color chip in response to receiving bus access permission.

34. The process for operating the printer formatter of claim 33, further comprising directly accessing the chip bus of the color chip over the chip bus of the monochrome chip.

35. A process for operating a printer formatter comprising:

storing image data;

using a monochrome chip to arbitrate access to the stored image data; and using a chip bus of the monochrome chip to directly access a bus of a color chip.

36. A process for operating a printer formatter comprising:

storing image data;

using a monochrome chip to arbitrate access to the stored image data; and communicating printer data from a printer client device to the monochrome chip.

* * * * *